United States Patent [19]

Leveugle

[11] Patent Number: 4,886,174

[45] Date of Patent: Dec. 12, 1989

[54] LOAD COMPENSATING DEVICE FOR A HANDLING MACHINE AND PROCESS FOR CARRYING OUT SUCH COMPENSATION

[75] Inventor: Jean Leveugle, Lyon, France

[73] Assignee: Reel S A, Caluire, France

[21] Appl. No.: 194,178

[22] Filed: May 16, 1988

[30] Foreign Application Priority Data

May 20, 1987 [FR] France ..... 87 07277

[51] Int. Cl.[4] ..... B66C 19/00

[52] U.S. Cl. ..... 212/149; 212/156; 212/195

[58] Field of Search ..... 212/149, 150, 151, 152, 212/153, 155, 156, 195, 196, 197

[56] References Cited

U.S. PATENT DOCUMENTS

| | | | |
|---|---|---|---|
| 3,035,712 | 5/1962 | Nowack | 212/150 |
| 3,896,938 | 7/1975 | Eich et al. | 212/156 |
| 4,042,213 | 8/1977 | Schreyer et al. | 212/149 |
| 4,487,741 | 12/1984 | Vuckovich et al. | 212/149 |
| 4,597,497 | 7/1986 | Aberegg | 212/149 |

FOREIGN PATENT DOCUMENTS

| | | | |
|---|---|---|---|
| 1225805 | 4/1986 | U.S.S.R. | 212/156 |

*Primary Examiner*—Sherman D. Basinger
*Assistant Examiner*—Stephen P. Avila
*Attorney, Agent, or Firm*—Dowell & Dowell

[57] ABSTRACT

This invention relates to a load compensating device of the type comprising a detector adapted to stop displacement of the load in the event of said load encountering an obstacle and the reaction of this load thereon varying more or less with respect to a threshold, wherein it comprises:—a fixed armature comprising two end stops;—a sliding block adapted to slide in the armature between its end stops;—an outer bell element provided with means adapted to cooperate with the sliding block;—an overload jack disposed between the sliding block and the armature;—an underload jack housed between the sliding block and the outer bell element;—a counterweight to which the cable for handling the load is attached and axially mobile between two limits with respect to the outer bell element;—and an electropneumatic circuit for modulated supply of the jacks as a function of the variations in the load.

18 Claims, 5 Drawing Sheets

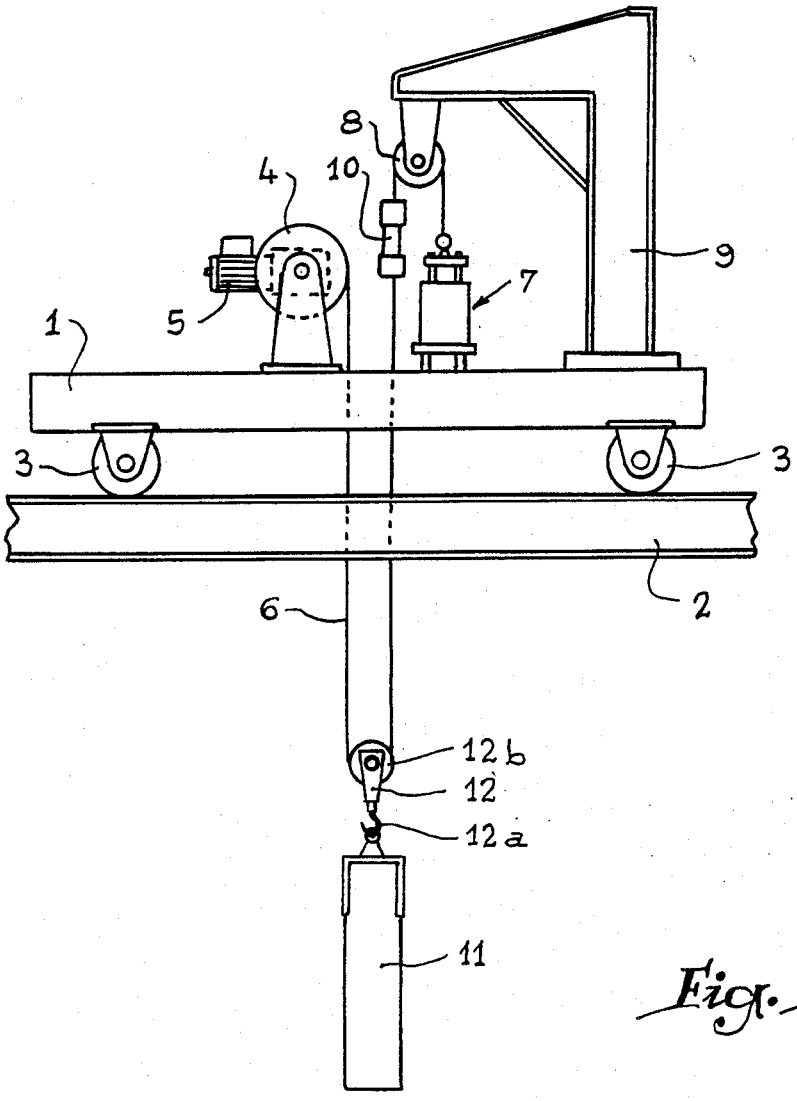
Fig. 1
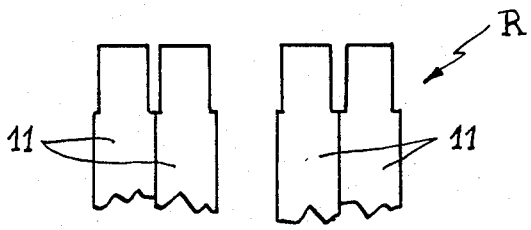

LOAD COMPENSATING DEVICE FOR A HANDLING MACHINE AND PROCESS FOR CARRYING OUT SUCH COMPENSATION

BACKGROUND OF THE INVENTION

1. Field of the Invention

The present invention generally relates to lifting machines and more particularly, but not exclusively, to travelling cranes intended for handling delicate loads.

2. History of the Related Art

In this type of operation, a cable is used, of which one end is wound on a drum while its opposite end is anchored to the carriage of the handling machine, the cable passing on the one hand around an idle pulley mounted to rotate above the point of anchoring, and, on the other hand, around the idle pulley of a mobile block with hook to which the load is hooked, for example by means of a grab. Between the idle pulley and the block, there is inserted in the cable a scale associated with means for stopping the control of rotation of the drum if the cable is subjected to overload or underload. The former occurs if the load encounters an obstacle while it is being lifted, while underload occurs if the load encounters an obstacle during its descent.

The electrical devices used in connection with the scale and the drive motor of the winch present excessive response times to allow an immediate stoppage of the displacement of the load both in the rising and in the descending direction, with the result that the load may be damaged when a mishap occurs.

SUMMARY OF THE INVENTION

It is an object of the improvements according to the present invention to overcome the above referenced drawback by providing a device so inserted in the kinematic lifting chain, that it maintains the tension of the cable between two limits corresponding to the admitted values of the overload and underload.

The invention allows the displacement of the load to be stopped in the event of the load encountering an obstacle if the reaction of this load thereon varies more or less with respect to a threshold.

To that end, the device according to the invention comprises, in combination:

- a fixed armature comprising two end stops;
- a sliding block adapted to slide in the armature between its end stops;
- an outer bell element provided with means adapted to cooperate with the sliding block;
- an overload jack disposed between the sliding block and the armature;
- an underload jack housed between the sliding block and the outer bell element;
- a counterweight to which the cable for handling the load is attached and axially mobile between two limits with respect to the outer bell element;
- and an electro-pneumatic circuit for modulated supply of the jacks as a function of the variations in the load.

BRIEF DESCRIPTION OF THE DRAWINGS

The invention will be more readily understood on reading the following description with reference to the accompanying drawings, in which:

FIG. 1 is a schematic view showing a travelling crane of which the carriage is equipped with a device according to the invention.

DESCRIPTION OF THE PREFERRED EMBODIMENT

Figure 2:
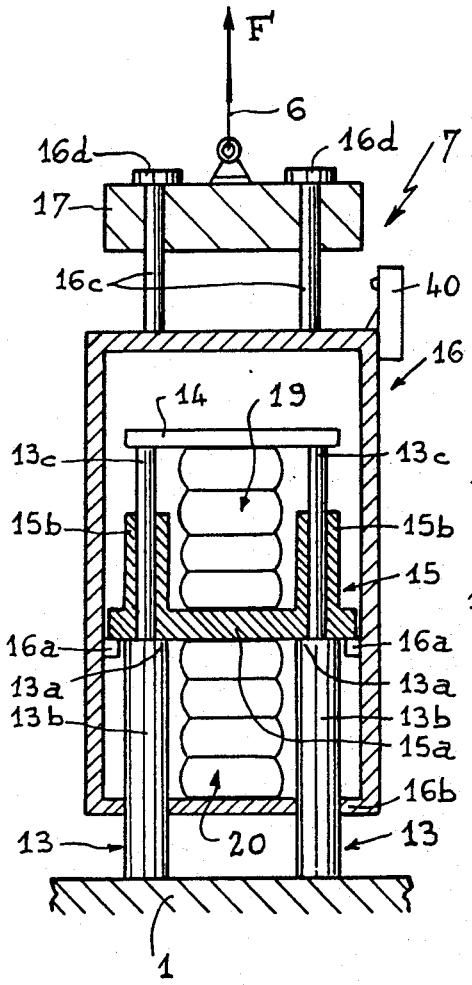
FIGS. 2 to 5 show the different phases of operation of the device according to the invention.
Figure 3:
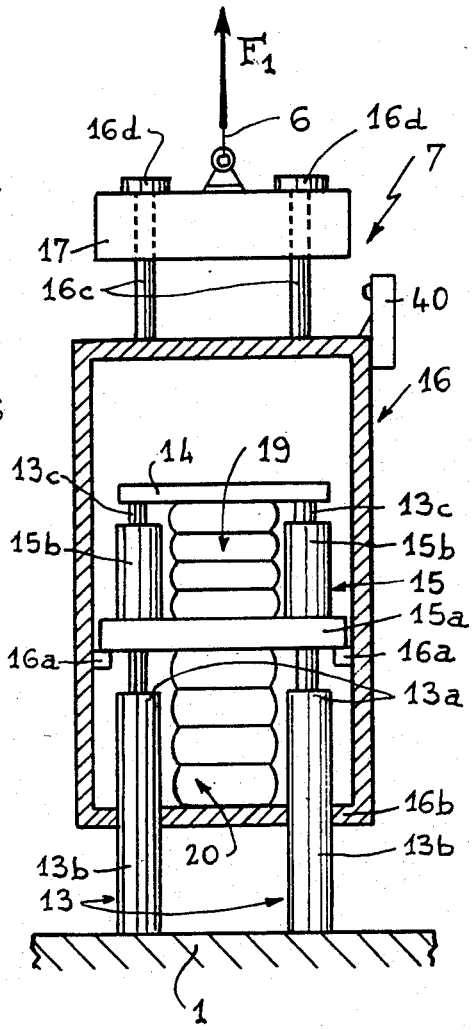
Figure 4:
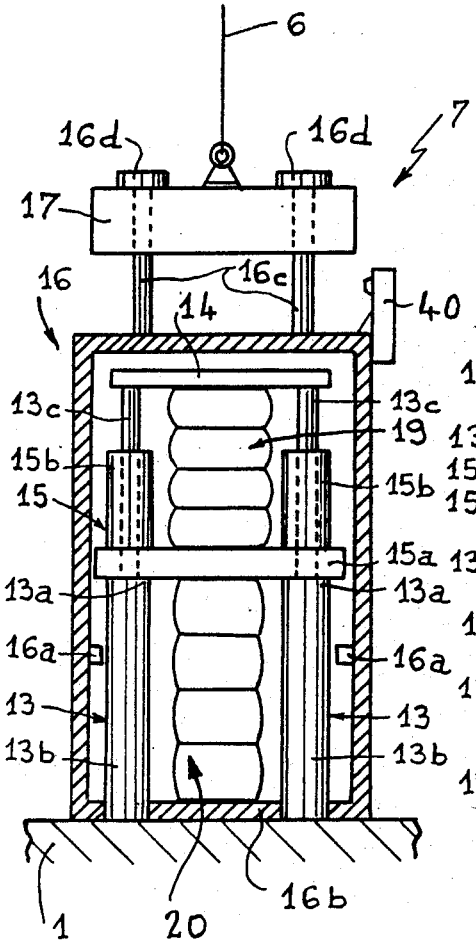

Referring now to the drawings, FIG. 1 illustrates the carriage 1 of a travelling crane moving over a runway 2 by means of rollers 3 and on which is mounted a winch 4, driven by an electric motor 5 and intended for winding a cable 6. One of the ends of this cable is associated with the drum of the winch 4, while its opposite end is fixed to the carriage 1 via a device 7 according to the invention. From this device, the cable passes around an idle pulley 8 mounted to rotate with respect to a bracket 9 secured to the carriage 1, then it cooperates with a scale 10.

The load 11 is hooked to the hook **12*a* of a mobile pulley block 12, around whose pulley 12*b* the cable 6** passes before winding on the winch.

The problem raised in non-limiting manner in the embodiment illustrated is the handling of the load 11 which must be either removed from or returned in position in a row R of tightly packed loads 11. It will be readily understood that, when a load 11 is extracted, an excess tension is produced, therefore an overload of the cable 6 if such load catches on one of the adjacent ones. On the contrary, when a load 11 is placed in position in a free space in the row R, an under-tension is produced, or underload of the cable if the load abuts against one of the adjacent ones or against any obstacle.

The device 7 of FIG. 1 solves the problem raised by such incidents.

As illustrated in FIGS. 2 to 5, it firstly comprises a fixed armature composed of at least two columns 13 with two diameters which determine therebetween a shoulder **13*a*. The columns are thus constituted by a shank 13*b* of which the lower end is fastened to the carriage 1 and an end part 13*c* following the shank after the shoulder 13*a*. The free ends of the two parts 13*c* of the columns 13 are joined by a crosspiece 14**.

A sliding block 15 may slide along the end parts **13*c* of the columns. It comprises a plate 15*a* and two sleeves 15*b* surrounding the columns and intended to limit the upward stroke of the sliding block by their free ends stopping against the crosspiece 14. The second stop of the armature is, of course, constituted by the shoulders 13*a***.

The whole of the armature and the sliding block is surrounded by a bell element 16 provided with inner catches **16*a* disposed so as to be able to cooperate with the underneath of the plate 15*a*** of the sliding block under the conditions which will be more easily explained hereinbelow.

The base of the bell element is closed by a bottom **16*b* comprising perforations traversed with functional clearance by the shanks 13*b* of the columns 13** to ensure guiding of the bell element.

The latter comprises on its upper part two small vertical columns **16*c* which pass through two perforations made in a counterweight 17 to which the cable 6 is anchored. It is observed that the free end of the two columns 16***c* is provided with a stop 16*d*. Finally, two pneumatic jacks supplied by a source of pressure 18 (FIG. 6) are placed respectively between the crosspiece 14 and the sliding block 15 (jack referenced 19) and, on the other hand, between said sliding block 15 and the bottom 16*b* of the bell element 16 (jack referenced 20). In the following specification, jack 19 is referred to as overload jack, while jack 20 is referred to as underload jack.

Operation is as follows:

When the system is balanced, i.e. when no obstacle is encountered by the load, the pressures respectively in the jacks 19 and 20 are called PU1 and PO1. The latter is provided so that in no case can it displace the sliding block 15 with respect to the bell element 16, with the result that the sliding block 15 remains in abutment against the shoulders 13*a* and the catches 16*a* remain in contact with the sliding block 15 as the pressure PU1 prevailing in the jack 19 is high and in any case greater than PO1. This balance remains as long as the force F of cable tension does not exceed a given threshold. In other words, the action of the pressure PO1 is translated by a force less than that F, whilst the action of PU1 is greater than F.

It will, of course, be noted that the counterweight 17 is in abutment against the stops 16*d* of the small columns 16*c*.

In the event of overload, the additional tension causes rise of the sliding block 15 by the catches 16*a* of the bell element 16 which rises firstly due to the overload since F has become F1 greater than F, and then due to the change in pressure prevailing in the jack 19 which has become PU2, less than PU1. The rise of the bell element and of the sliding block makes it possible to maintain constant the tension in the cable during the stop of the movement effected in a period of time which allows the electrical devices to stop the lifting of the load 11 before the sliding block 15 comes into abutment against the crosspiece 14.

The choice of the pressure PU2 means that the time necessary for stopping the winch 4 is less than that corresponding to the displacement under the above conditions of the sliding block and of the bell element 16, from the position of FIG. 2 to the maximum position that can be accepted when the sliding block comes into abutment against the crosspiece 14.

In the event of underload, the displacement of the bell element 16 is the reverse, i.e. the catches 16*a* leave the sliding block 15 so as to act on the cable 6 during the response time of the electrical apparatus.

Under these conditions, the pressure P02 sent into the jack 20 is greater than that PO1 developed in this jack in the position of equilibrium, the pressure P02 being greater than that PU1 prevailing in the jack 19.

There again, the downward stroke of displacement of the bell element 16 is provided widely sufficient for the response times of the electrical apparatus to be less than the total descent time of the bell until it bears against carriage 1. Of course, these conditions are directly dependent on the characteristics of the underload jack 20 and on the value of the pressure P02 with respect to pressure PO1.

Figure 5:
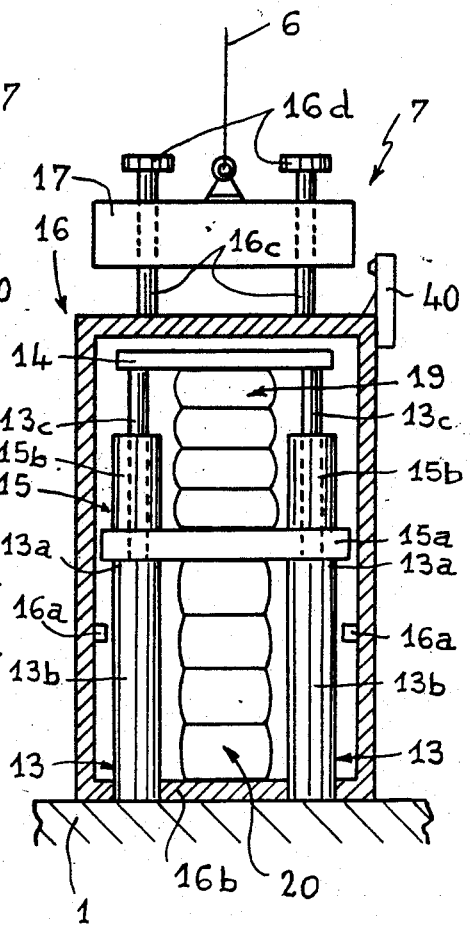

Finally, FIG. 5 illustrates a last possibility in which, upon normal stop in low position, the counterweight 17 balances the mass of the assembly of the mobile pulley block 12 with hook and that of all the accessories so as not to exert a force on the suspended load which has just been placed. It is noticed that, at that moment, the counterweight descends in the direction of the bell element 16 along the small columns 16*c* to allow safety stop thanks to the presence of a detector 40 (FIGS. 2 to 5).

Figure 6:
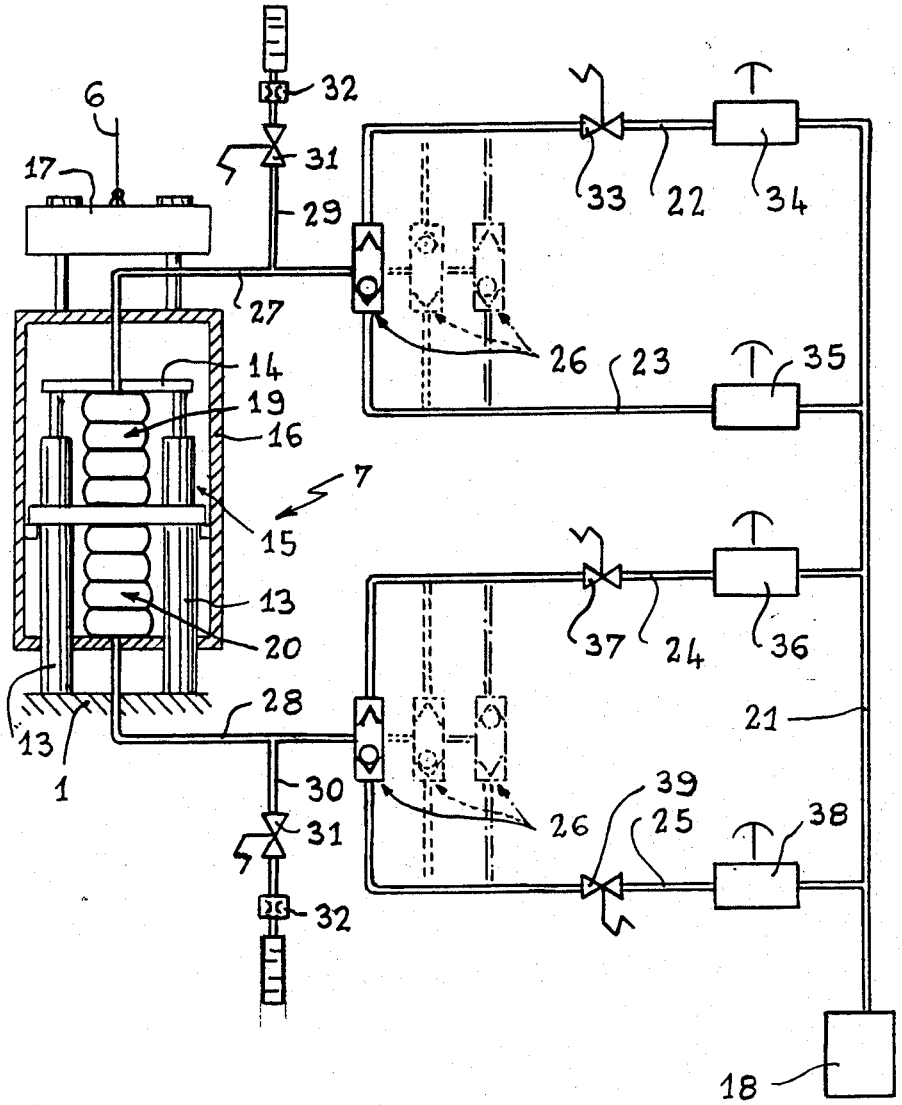
FIG. 6 illustrates the diagram of the compressed air supply of the jacks of the device according to the invention as a function of the different phases of operation.

The pneumatic supply system of the jacks which has been illustrated in FIG. 6 is described hereinafter:

From the source of pressure 18 issues a pipe 21 constituting the origin of four conduits referenced 22, 23, 24 and 25, which are joined in two's to form a loop closing via a double non-return valve 26 of which the outlet is connected to a pipe 27, 28 terminating respectively at jacks 19 and 20. From each pipe 27, 28 issues a pipe 29, 30 leading to the atmosphere and in each of which are inserted, on the one hand, an electro-valve 31, and, on the other hand, a flow reducer 32.

An electro-valve 33 and a pressure reducer 34 are inserted in the conduit 22.

In conduit 23 is inserted a pressure reducer 35. Similarly, a pressure reducer 36 is inserted in conduit 24 together with an electro-valve 37; finally a fourth pressure reducer 38 is placed in the conduit 25 together with an electro-valve 39.

By way of example, the pressure reducers are adjusted for particular application to the following pressures: member 34 to 5.5 bars, member 35 to 2 bars, member 36 to 2.5 bars, member 38 to 5 bars.

During normal displacement of a load, electro-valves 33 and 37 are open (electro-valve 39 being closed), with the result that the jacks 19 and 20 are supplied with pressures PU1 and PO1 determined by the pressure reducers 34 and 36. The ball rests on its lower seat in the two non-return valves 26. Due to the pressures defined hereinabove, the pressure PU1 in jack 19 (5.5 bars) is greater than pressure PO1 in jack 20 (2.5 bars).

It will be indicated by way of information that, if the hook moves without load, pneumatic supply of the underload jack is effected at zero pressure, i.e. in that case the electro-valve 31 is opened whilst those 37 and 39 are closed.

If an overload occurs, it is detected by the scale 10 which transmits the order to a control cabinet which adjusts the system in the following manner: valve 33 is closed, with the result that cylinder 19 is supplied under a pressure PU2, less than PU1, equal to two bars. The ball of the corresponding double non-return valve 26 rises against the upper seat, as illustrated in broken lines.

As to the supply of jack 20, it is not modified and is effected under the pressure PO1 of 2.5 bars, so that the ball of the second double non-return valve 26 remains on its lower seat, as shown in broken lines.

In the event of an underload likewise detected by scale 10, the latter transmits the information to the electrical cabinet. The latter emits orders causing opening of electro-valve 39, with the result that the jack 5 is supplied under a pressure P02 greater than that of PO1 (5 bars instead of 2.5). The ball of the corresponding double valve 26 rises against its upper seat, as illustrated in discontinuous lines. As to the supply of jack 19, it is effected under a pressure PU1 of 5.5 bars, i.e. greater than that supplying the jack 20, since the electro-valve 33 is open. It will be noted that, in any case, except the one specified in which the pressure 20 is zero, the valve 31 is continually closed.

Figure 7:
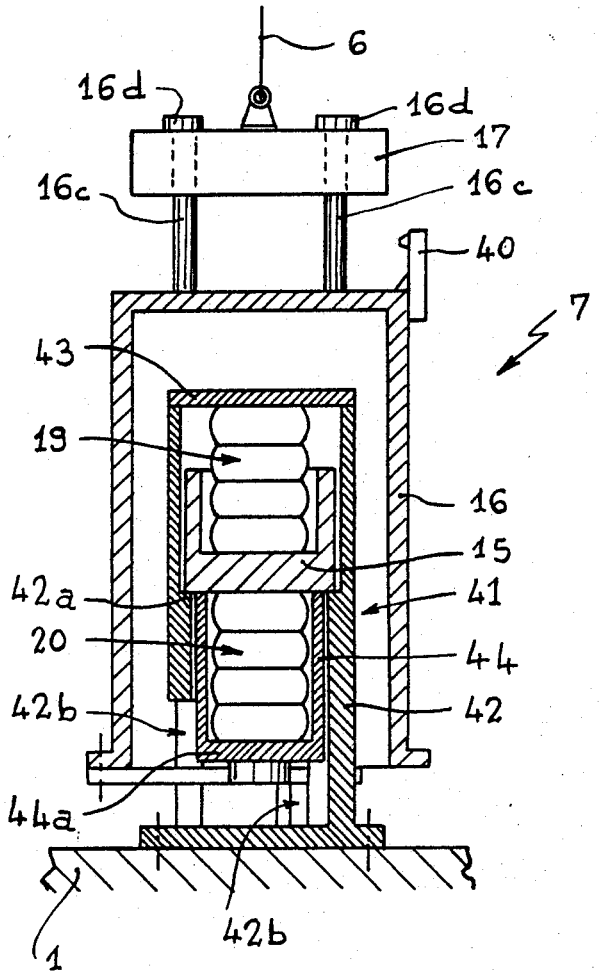
FIG. 7 is a view similar to that of FIG. 2, but showing a variant embodiment.

According to a variant embodiment illustrated in FIG. 7, the armature 13–14 of FIGS. 2 to 5 is constituted by an assembly 41 comprising a tubular element 42 closed at its lower end and open at its opposite end. This end is obturated by a cover 43. The central passage of the tubular element 42 presents two diameters with a view to constituting a shoulder 42*a* facing the cover 43. The latter and the shoulder 42*a* form stops similar to those 13*a* and 14 of the embodiment of FIGS. 2 to 5.

The bottom 16*b* of the bell element 16 is constituted by three radial arms traversing openings 42*b* in the tubular element 42. The centre of this bottom cooperates with the base 44*a* of a tubular crosspiece 44 which bears beneath the sliding block 15. It will be observed that the jack 20 rests on the inner face of the base 44*a*.

In this embodiment, the sliding block 15 presents a shape similar to that illustrated in the preceding Figures, but it is guided on the outside by the part of larger diameter of the inner passage of the tubular element 42. As in FIGS. 2 to 5, it moves under the effect of the movement of the bell element 16, and via the tubular crosspiece 44 between the shoulder 42*a* and the cover 43.

It must, moreover, be understood that the foregoing description has been given only by way of example and that it in no way limits the domain of the invention which would not be exceeded by replacing the details of execution described by any other equivalents.

In particular, the device according to the invention may be applied to travelling cranes provided with a telescopic mast for displacing the loads.

What is claimed is:

1. A load compensating device of the type comprising a detector adapted to stop displacement of a cable to which the load is attached in the event the load encounters an obstacle and the reaction of the load developes forces on the cable varying above or below a threshold, wherein the device comprises:

a fixed armature having upper and lower end stops;

a sliding block adapted to slide in said armature between said end stops;

an outer bell element provided with engaging means adapted to cooperate with said sliding block;

an overload jack disposed between said sliding block and said armature;

an underload jack housed between said sliding block and said outer bell element;

a pressure supply communicating with each of said overload jack and said underload jack;

a counterweight to which the cable for handling the load is attached, said counterweight being axially moveable between two limits with respect to said outer bell element;

and control means for modulating said pressure supply to said overload and said underload jacks as a function of the variations in the load forces on the cable.

2. The device of claim 1, wherein said fixed armature includes at least two stepped columns having a lower shank of larger diameter than that of an upper end part, a shoulder formed between said lower shank and said upper end parts, said upper end parts of said stepped columns having free ends which engage a crosspiece, said shoulders of said two columns and said crosspiece forming said upper and lower end stops of said armature.

3. The device of claim 2, wherein said sliding block is made in the form of a plate sliding along said end parts of said columns of said fixed armature by sleeve means mounted to said plate and extending toward said crosspiece, said sleeve means limiting the stroke of said sliding block.

4. The device of claim 3, wherein the outer bell element includes a bottom wall having spaced openings therein, said lower shanks of said columns extending through said openings, said bell element further having a top wall, column means extending from said top wall, and stops formed along said column means.

5. The device of claim 4, wherein the counterweight is mounted to slide with respect to said column means of said bell element.

6. The device of claim 1, wherein said bell element includes a bottom wall, said overload and underload jacks being respectively in abutment against said crosspiece and said sliding block, and against said crosspiece and said bottom wall of said bell element.

7. The device of claim 1, wherein the pressure supply includes two branches intended respectively to supply said overload and said underload jacks, each branch including valve means for supplying variable pressures (PU1, PU2) for said overload jack and (PO1 and PO2)-said underload jack.

8. The device of claim 7 in which said control means determines the pressure PU1 applied to said overload jack and that PO1 applied to said underload jack such that the force developed by said jacks maintains said sliding block in abutment against said lower stop of said armature during periods when the load encountered is within the threshold.

9. The device of claim 7 in which said control means applies to said overload jack a pressure PU2 less than the PU1 during periods when the load encountered is above the threshold.

10. The device of claim 7 in which said control means applies to said underload jack a pressure PO2 greater than the PO1 during periods when the load encountered is below the threshold.

11. A load compensating device of the type comprising a detector adapted to stop displacement of a cable to which the load is attached in the event the load encounters an obstacle and the reaction of the load develops forces on the cable varying above or below a threshold wherein the device comprises, a fixed armature having upper and lower end stops, a sliding block adapted to slide in said armature between said end stops, an outer bell element provided with engaging means adapted to cooperate with said sliding block, an overload jack disposed between said sliding block and said armature, an underload jack housed between said sliding block and said outer bell element, a pressure supply communicating with each of said overload jack and said underload jack, a counterweight to which the cable for handling the load is attached, said counterweight being moveable between two limits with respect to said outer bell element, and control means for modulating said pressure supply to said overload and said underload jacks as a function of the variations in the load forces on the cable, said armature including a tubular element closed at one end by a cover, said tubular element having a central passage, a shoulder extending into said central passage, said shoulder and said cover forming said upper and lower stops of said armature between which said sliding block moves, said sliding block being connected to said bottom of said bell element by a tubular cross piece surrounding said underload jack.

12. The device of claim 11 wherein said fixed armature is secured to the carriage of a lifting machine.

13. The device of claim 11 wherein the pressure supply includes two branches intended respectively to supply said overload and said underload jacks, each branch including valve means for supplying variable pressures (PU1, PU2) for said overload jack and (PO1 and PO2) for said underload jack.

14. The device of claim 13 in which said control means determines the pressure PU1 applied to said overload jack that PO1 applied to said underload jack such as the force developed by said jacks maintains said sliding block in abutment against said lower stop of said armature during periods when the load forces encountered is within the threshold.

15. The device of claim 13 in which said control means applies to said overload jack a pressure PU2 less than that PU1 during periods when the load forces encountered are above the threshold.

16. The device of claim 13 in which said control means applies to said underload jack a pressure PO2 greater than that PO1 during periods when the load forces encountered are below the threshold.

17. A load compensating device of the type comprising a detector adapted to stop displacement of a cable to which the load is attached in the event the load encounters an obstacle and the reaction of the load develops forces on the cable varying above or below a threshold wherein the device comprises, a fixed armature having at least two step columns, said two step columns having a lower shank of larger diameter than that of an upper end part thereof, a shoulder formed between said lower shank and said upper end parts, said upper end parts of said step columns having free ends which engage a crosspiece, said shoulders of said two columns and said crosspiece forming an upper and lower end stops of said armature, a sliding block adapted to slide in said armature between said upper and lower end stops, said sliding block being in the form of a plate sliding along said end parts of said columns of said fixed armature by sleeves mounted to said plate and extending toward said crosspiece, said sleeves limiting the stroke of said sliding block toward said crosspiece, an outer bell element provided with engaging means adapted to cooperate with said sliding block, said outer belt element including a bottom wall having spaced openings therein, said lower shanks of said columns extending through said openings, said bell element further having a top wall, column means extending from said top wall, stop means formed along said column means, an overload jack disposed between said sliding block and said armature, an underload jack housed between said sliding block and said outer bell element, a counterweight to which the cable for handling the load is attached, said counterweight being axially moveable between two limits with respect to said outer bell element, and control means for modulating said pressure supply to said overload and said underload jacks as a function of the variation in the load forces on the cable.

18. The device of claim 17 wherein the counterweight is mounted to slide with respect to said column means of said bell element.

* * * * *